US011255572B2

(12) United States Patent
McElvany et al.

(10) Patent No.: US 11,255,572 B2
(45) Date of Patent: Feb. 22, 2022

(54) DRAIN PAN WITH OVERFLOW FEATURES

(71) Applicant: Johnson Controls Technology Company, Auburn Hills, MI (US)

(72) Inventors: John L. McElvany, Norman, OK (US); Curtis A. Trammell, Newcastle, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 209 days.

(21) Appl. No.: 16/736,701

(22) Filed: Jan. 7, 2020

(65) Prior Publication Data

US 2021/0190371 A1 Jun. 24, 2021

Related U.S. Application Data

(60) Provisional application No. 62/951,420, filed on Dec. 20, 2019.

(51) Int. Cl.
*F24F 13/00* (2006.01)
*F24F 13/22* (2006.01)
*F28F 17/00* (2006.01)

(52) U.S. Cl.
CPC ..... *F24F 13/222* (2013.01); *F28F 17/005* (2013.01)

(58) Field of Classification Search
CPC ..... F24F 13/222; F28F 17/005
See application file for complete search history.

(56) References Cited

U.S. PATENT DOCUMENTS

| | | | | |
|---|---|---|---|---|
| 4,095,426 | A * | 6/1978 | Rhodes | F01K 25/02 60/496 |
| 5,379,749 | A * | 1/1995 | Rieke | F24H 8/006 126/110 R |
| 6,895,770 | B1 | 5/2005 | Kaminski | |
| 6,978,909 | B2 | 12/2005 | Goetzinger et al. | |
| 8,220,282 | B2 | 7/2012 | Hast et al. | |
| 8,474,282 | B2 | 7/2013 | Hsiao | |
| 8,683,821 | B2 * | 4/2014 | Volk | B01D 29/605 62/291 |
| 8,869,548 | B2 | 10/2014 | Piccione | |
| 9,080,786 | B2 | 7/2015 | Rowland | |
| 9,664,461 | B2 | 5/2017 | Mercer et al. | |
| 10,132,523 | B2 | 11/2018 | Barbely et al. | |
| 2010/0226104 | A1 | 9/2010 | Takeichi et al. | |

FOREIGN PATENT DOCUMENTS

| | | | |
|---|---|---|---|
| WO | 2018120748 | A1 | 7/2018 |
| WO | 2018180246 | A1 | 10/2018 |

* cited by examiner

*Primary Examiner* — Filip Zec
(74) *Attorney, Agent, or Firm* — Fletcher Yoder, P.C.

(57) ABSTRACT

A heating, ventilation, and/or air conditioning (HVAC) unit includes a drain pan including a basin defined by a base and a plurality of side walls configured to collect condensate from an evaporator of the HVAC unit. The HVAC unit also includes a drain port disposed in the base of the basin and arranged such that the drain pan is configured to direct the condensate toward the drain port and out of the basin, a protruded portion extending from an outer surface of a side wall of the plurality of side walls, and a passage proximate to a top edge of the side wall of the plurality of side walls and configured to facilitate overflow of the condensate out of the basin and along the protruded portion.

25 Claims, 11 Drawing Sheets

DRAIN PAN WITH OVERFLOW FEATURES

CROSS REFERENCE TO RELATED APPLICATIONS

This application claims priority from and the benefit of U.S. Provisional Application Ser. No. 62/951,420, entitled "DRAIN PAN WITH OVERFLOW FEATURES," filed Dec. 20, 2019, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. Condensate may accumulate on various components of the HVAC system and may flow along the components, such as due to an air flow and/or gravity. The condensate may be collected within a drain pan, and a drain spout may direct the condensate out of the drain pan to remove the condensate from the HVAC system. However, in some circumstances, the drain spout may not sufficiently remove condensate from the drain pan and therefore, condensate may overflow out of the drain pan.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) unit includes a drain pan including a basin defined by a base and a plurality of side walls configured to collect condensate from an evaporator of the HVAC unit. The HVAC unit also includes a drain port disposed in the base of the basin and arranged such that the drain pan is configured to direct the condensate toward the drain port and out of the basin, an offset portion extending from an outer surface of a side wall of the plurality of side walls, and a passage proximate to a top edge of the side wall of the plurality of side walls and configured to facilitate overflow of the condensate out of the basin and along the offset portion.

In one embodiment, a drain pan for a heating, ventilation, and/or air conditioning (HVAC) unit includes a base, a plurality of side walls integrally formed with the base to define a basin configured to collect condensate generated by the HVAC unit, and a drain port coupled to a first side wall of the plurality of side walls and configured to direct the condensate out of the basin. The HVAC unit further includes an offset portion extending from an outer surface of a second side wall of the plurality of side walls, and a passage proximate to a top edge of the second side wall of the plurality of side walls and configured to facilitate overflow of the condensate out of the basin and along the offset portion.

In one embodiment, a heating, ventilation, and/or air conditioning (HVAC) unit includes a drain pan including a base, a plurality of side walls integrally formed with the base, a basin defined by the base and the plurality of side walls, and a passage formed in a side wall of the plurality of side walls. The basin is configured to collect condensate from an evaporator of the HVAC unit, and the passage is configured to direct condensate overflow out of the basin. The HVAC unit also includes a drain port disposed in the base and configured to direct the condensate out of the basin and an offset portion extending from an outer surface of the side wall of the plurality of side walls proximate the passage, such that the condensate overflow is directed through the passage and along the offset portion.

DRAWINGS

Various aspects of this disclosure may be better understood upon reading the following detailed description and upon reference to the drawings in which.

DETAILED DESCRIPTION

Figure 1:
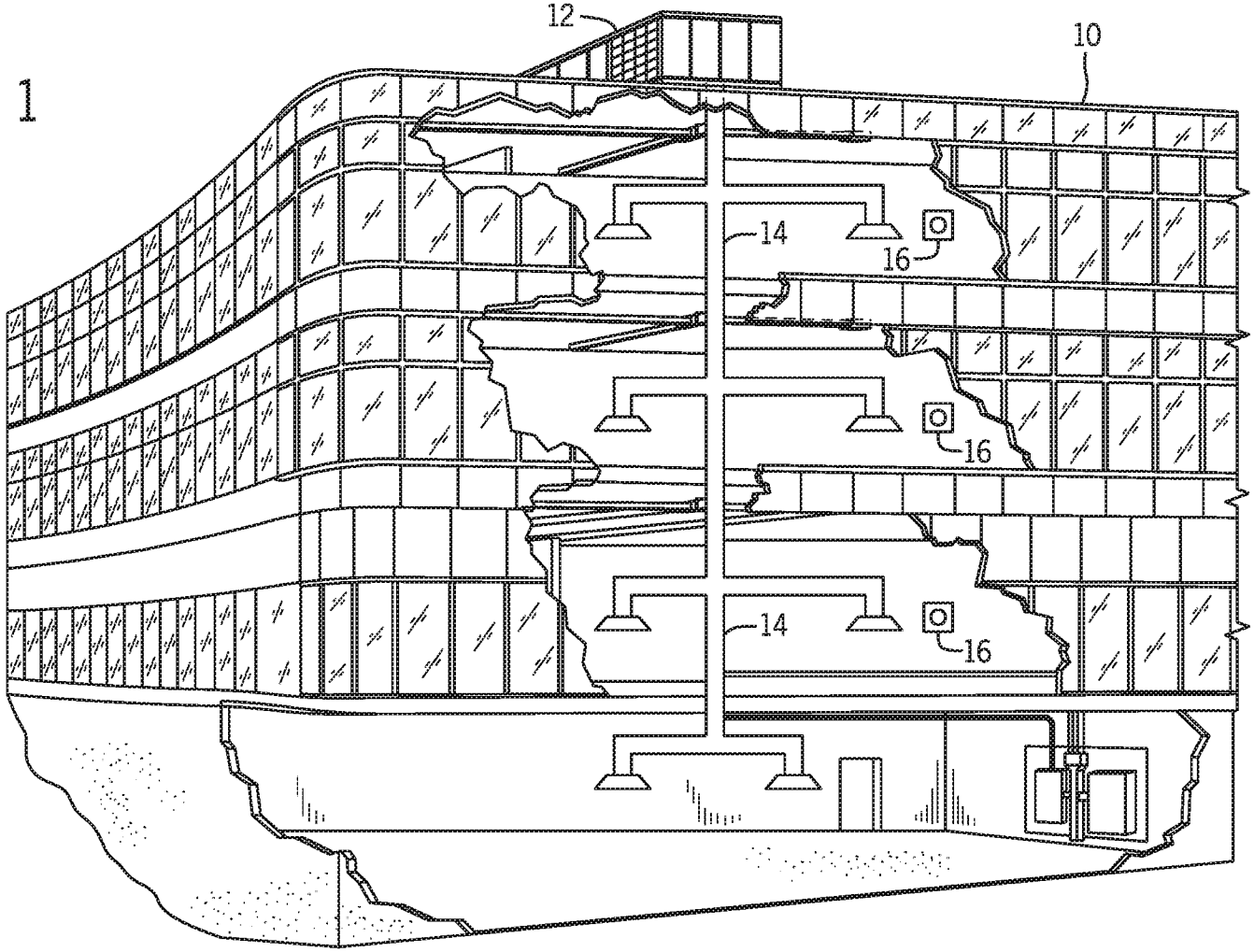
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may utilize a heat exchanger for transferring heat or thermal energy between a fluid, such as an air flow, and a refrigerant flowing through the HVAC system, thereby conditioning the fluid. For example, the heat exchanger may be an evaporator in which the refrigerant absorbs thermal energy from the fluid to cool the fluid. The cooled fluid may then be directed to a structure conditioned by the HVAC system so as to cool the structure.

During operation of the HVAC system, condensate may form on the heat exchanger or on another component of the HVAC system. For instance, cooling an air flow may cause moisture contained in the air flow to condense. The condensed moisture may form as condensate on the heat exchanger and may flow along the heat exchanger, such as due to gravity and/or due to air forced across the heat exchanger. For this reason, the HVAC system may include a drain pan that may collect condensate flowing off the heat exchanger, and the drain pan may direct collected condensate in a desirable manner. For example, the drain pan may include or be fluidly coupled to a drain spout configured to direct the condensate out of the HVAC system. However, in some circumstances, the drain spout may not direct the condensate out of the HVAC system at a sufficient rate. For example, the drain spout may be partially clogged and/or the drain pan may collect condensate at a high rate. As a result, the drain pan may be susceptible to condensate overflow out of the drain pan, and the condensate overflow may affect the performance or maintenance of the HVAC system.

Thus, it is presently recognized that directing overflowing condensate in a desirable manner through the HVAC system can improve the performance of the HVAC system. Accordingly, embodiments of the present disclosure are directed to a drain pan having a passage, such as an overflow passage, in addition to the drain spout. The passage directs condensate overflow out of the drain pan in a desirable manner, such as away from other equipment positioned proximate to the drain pan, so as to reduce a likelihood of contact between the condensate overflow and the other equipment. Thus, the drain pan may limit an impact of condensate overflow on the performance of the HVAC system. As used herein, condensate overflow refers to condensate collected within the drain pan and flowing out of the drain pan in a manner other than via the drain spout. For instance, the condensate overflow may flow out of the drain pan by flowing over top edges of side walls of the drain pan. In some embodiments, the passage may be formed in one of the side walls of the drain pan. Thus, when condensate collected within the drain pan exceeds a threshold level, the condensate may flow out of the drain pan via the passage, rather than out of another part of the drain pan, such as over other side walls of the drain pan. Therefore, the passage of the drain pan may improve operation of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
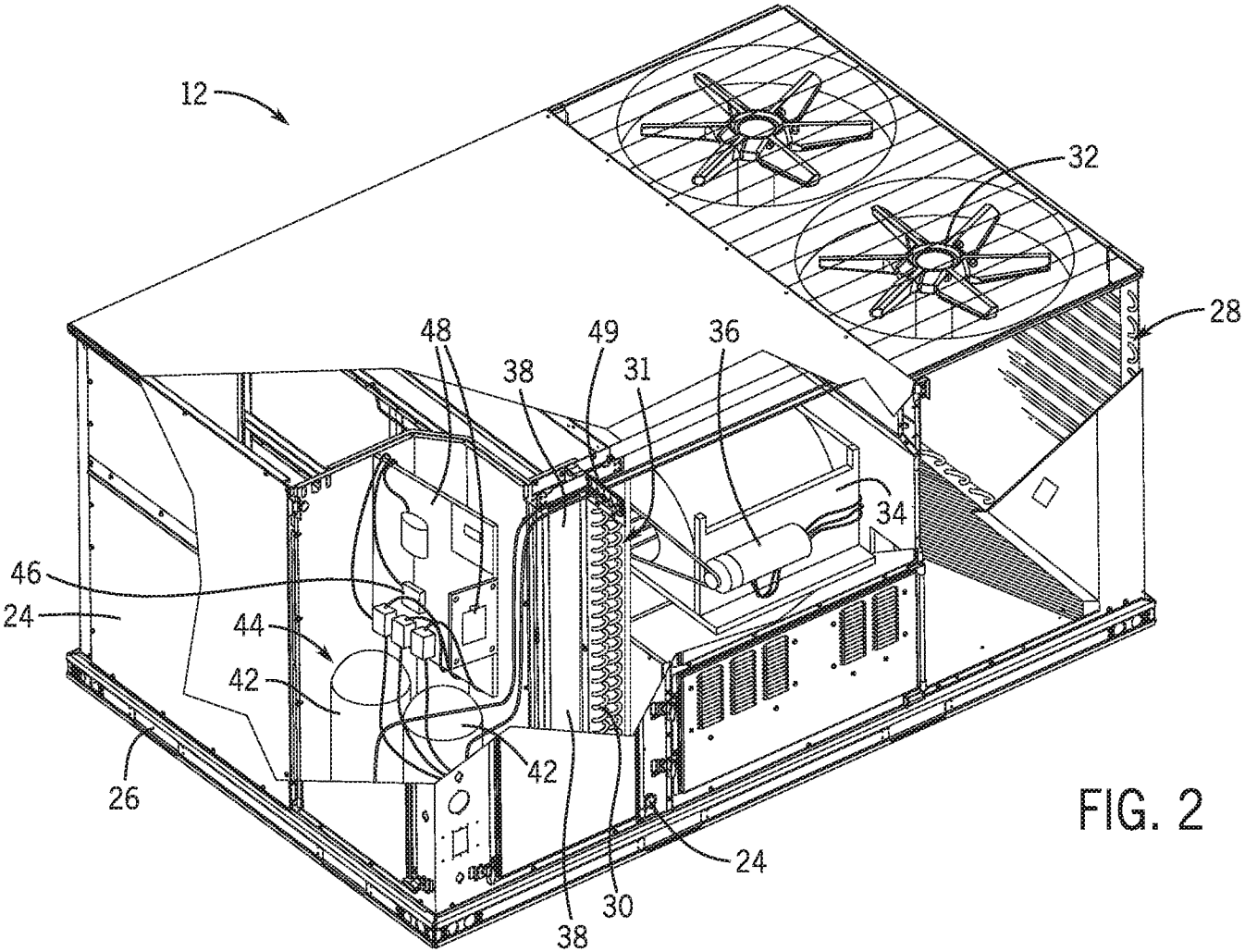
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
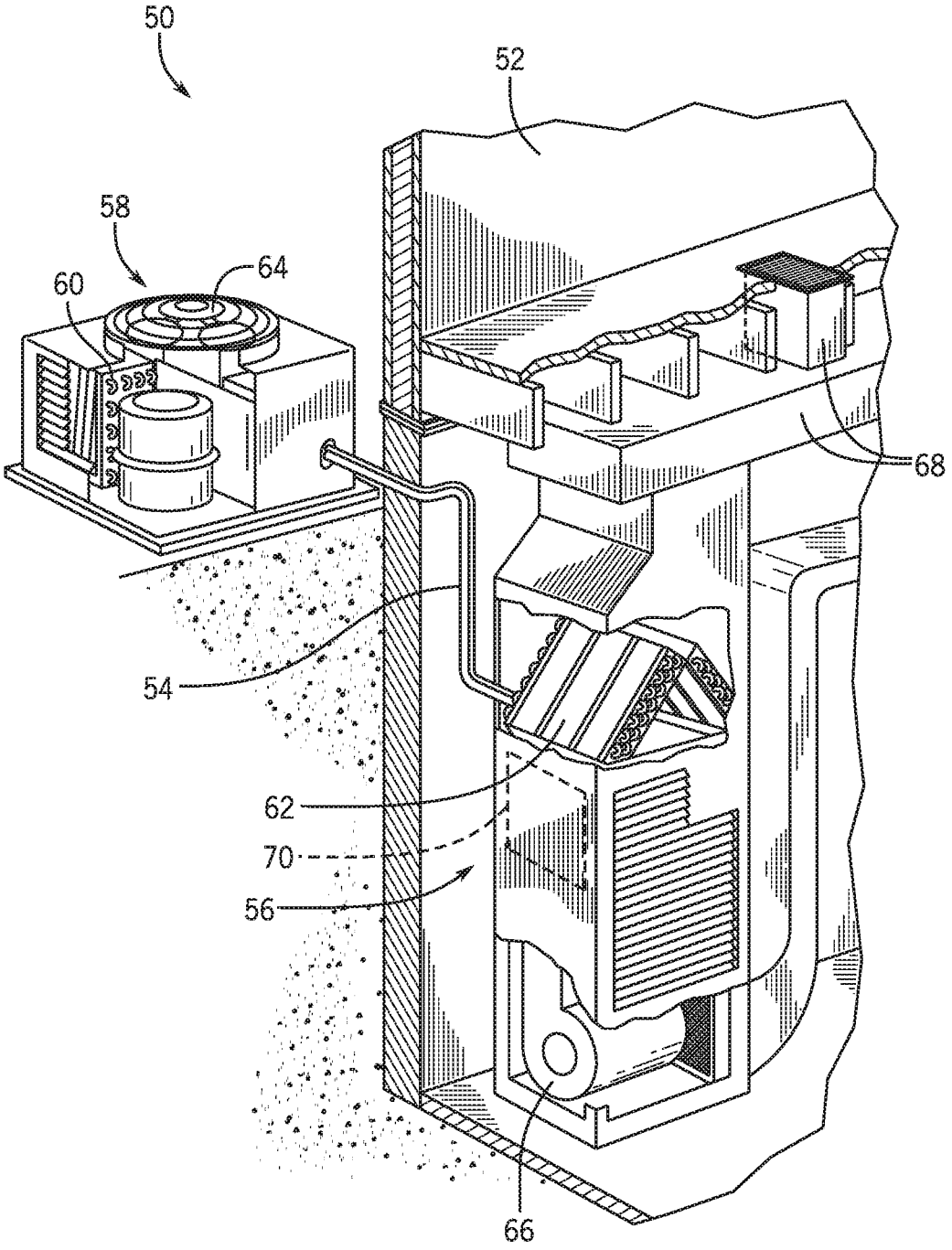
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
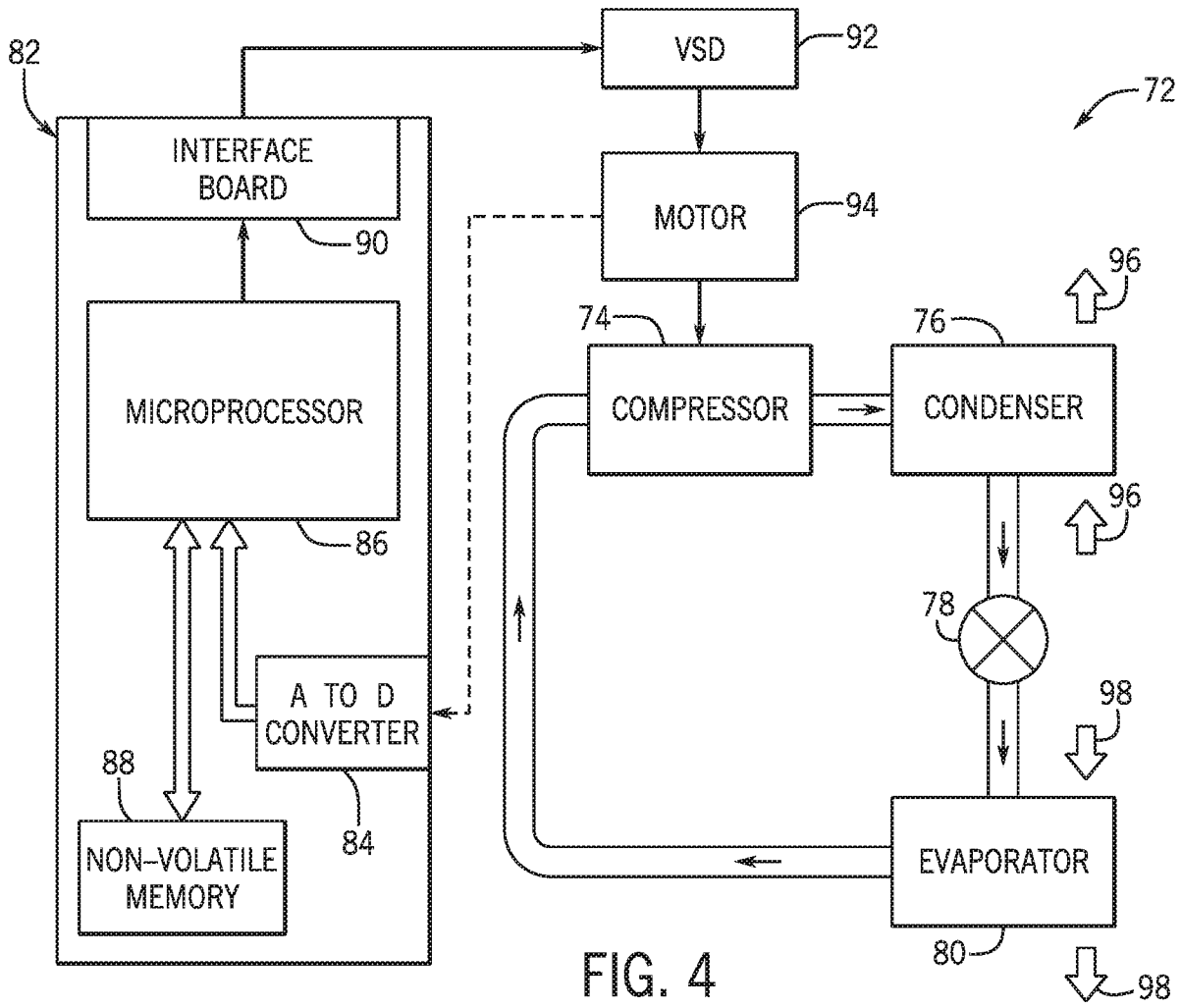
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to an HVAC system that has a drain pan configured to collect condensate generated by the HVAC system. The drain pan may have a drain spout configured to direct the condensate out of the drain pan to remove the condensate from the HVAC system. In some circumstances, the drain spout may not direct the condensate out of the drain pan at a sufficient flow rate. As a result, a level of the condensate within the drain pan may increase beyond a threshold level. For this reason, present embodiments of the drain pan may include a passage, also referred to herein as an overflow passage, configured to direct condensate overflow out of the drain pan in a desirable manner, such as away from other components of the HVAC system. The passage may be formed on one of the side walls of the drain pan and may receive condensate collected in the drain pan exceeding a threshold level. In some embodiments, the drain pan may additionally include a protrusion extending away from the side wall having the passage. The protrusion may abut another component of the HVAC system positioned proximate to the drain pan. The protrusion may form a channel or opening between the drain pan and the proximate component, and the condensate overflow may flow through the channel. In this way, the overflow of condensate may not flow toward or against the proximate component and/or other components of the HVAC system. Therefore, the condensate overflow may not affect operation of the proximate component and/or other components, thereby improving overall operation of the HVAC system.

Figure 5:
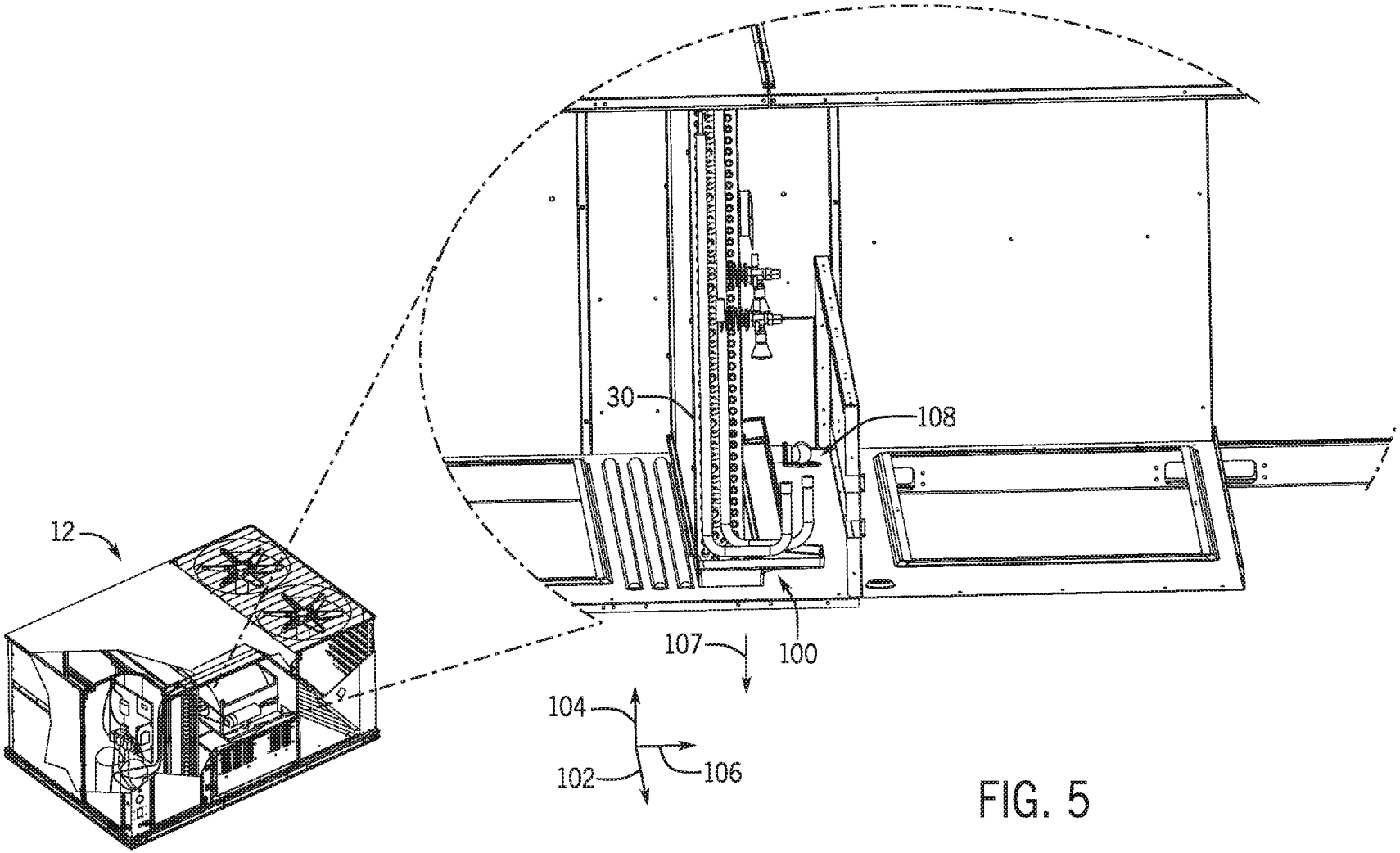
FIG. 5 is a partial expanded perspective view of an HVAC unit having a drain pan supporting a heat exchanger, in accordance with an aspect of the present disclosure.

With this in mind, FIG. 5 is a partial expanded perspective view of the HVAC unit 12 having a drain pan 100 supporting the heat exchanger 30. Certain features of the illustrated HVAC unit 12, such as side panels, walls, and certain components contained within the HVAC unit 12 are removed for better visualization of the drain pan 100. In additional or alternative embodiments, the drain pan 100 may be suitable for supporting any other heat exchanger, such as the heat exchanger 28, the evaporator 80 of the residential heating and cooling system 50 shown in FIG. 3, or another suitable heat exchanger. Indeed, it should be noted that the drain pan 100 may be included in embodiments or components of the HVAC unit 12, embodiments or components of the residential heating and cooling system 50, a rooftop unit (RTU), or any other suitable HVAC system.

To facilitate discussion, the drain pan 100 and its respective components will be described with reference to a lateral axis 102, a vertical axis 104, which is oriented relative to gravity, and a longitudinal axis 106. The drain pan 100 may be configured to receive the heat exchanger 30, such that the heat exchanger 30 is generally positioned above the drain pan 100 along the vertical axis 104. During operation of the HVAC unit 12, condensate may form on the heat exchanger 30. The condensate may travel in a downward direction 107 along the heat exchanger 30 to be collected by the drain pan 100. The drain pan 100 may include features to direct the collected condensate out of the drain pan 100, such as via a drain spout 108. The drain spout 108 may direct the collected condensate out of the HVAC unit 12. In this manner, the drain pan 100 blocks accumulation and/or flow of condensate in other portions of the HVAC unit 12.

Figure 6:
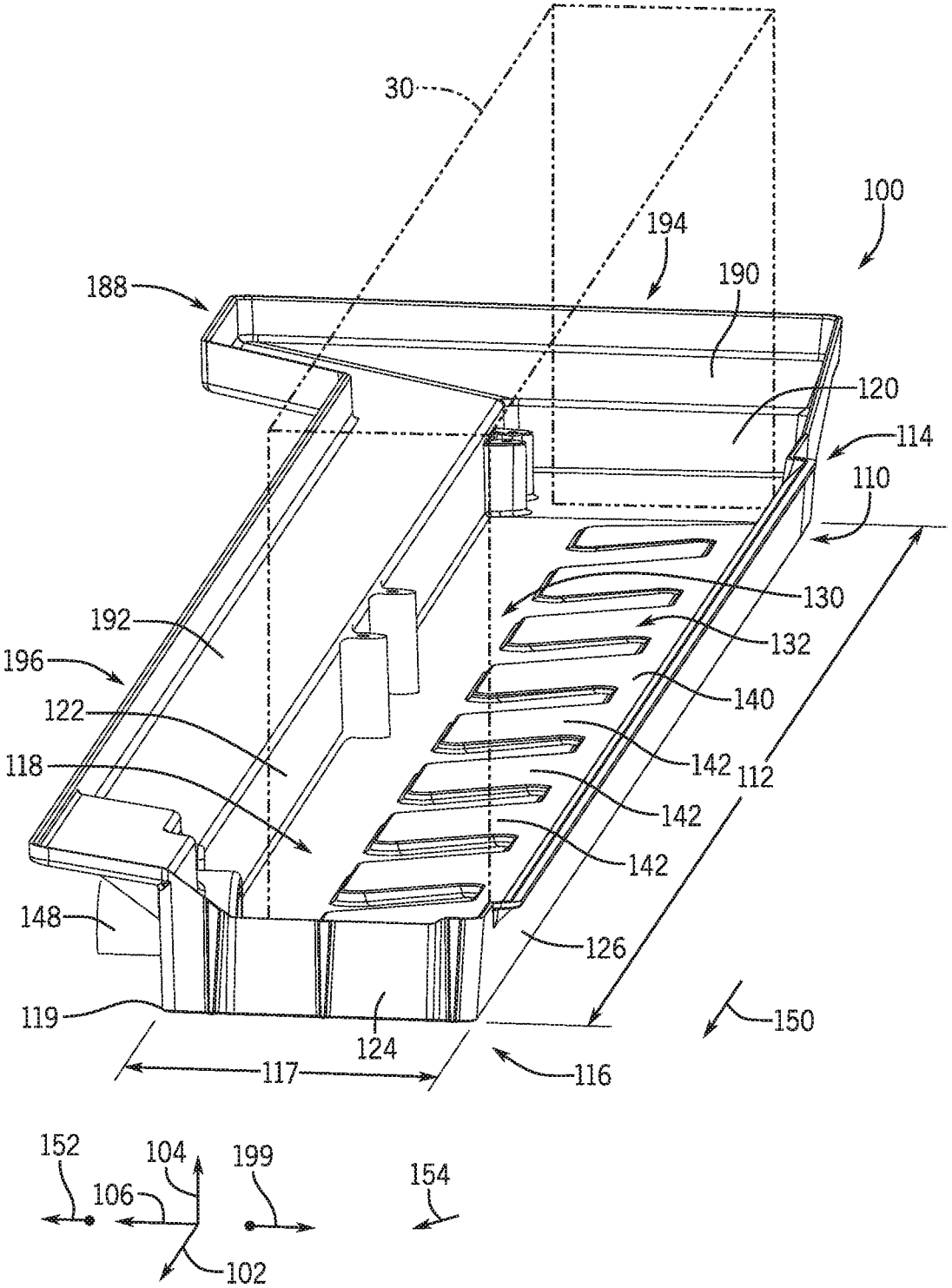
FIG. 6 is a perspective view of an embodiment of a drain pan, in accordance with an aspect of the present disclosure.

FIG. 6 is a perspective view of an embodiment of the drain pan 100. In the illustrated embodiment, the drain pan 100 includes a body portion 110 that extends along a length 112 of the drain pan 100 from a first end portion 114 of the drain pan 100 to a second end portion 116 of the drain pan 100. For clarity, it should be noted that the length 112 may extend generally parallel to the lateral axis 102, and a width 117 of the drain pan 100 may extend generally parallel to the longitudinal axis 106. The body portion 110 includes a basin 118 that is defined by a base 119, a first wall 120, a second wall 122, a third wall 124, and a fourth wall 126 of the body portion 110. As such, the first, second, third, and fourth walls 120, 122, 124, and 126 may define a perimeter of the basin 118. The basin 118 includes a draining surface 130 formed therein, as well as a raised surface 132 that extends from the draining surface 130. The raised surface 132 is configured to receive and engage with the heat exchanger 30, which is shown via phantom lines in the illustrated embodiment, in order to support a weight of the heat exchanger 30. Thus, the raised surface 132 supports the heat exchanger 30 within the basin 118 and above the draining surface 130 relative to the vertical axis 104.

For example, in some embodiments, the raised surface 132 may be a substantially planar surface that extends substantially level along the length 112 and the width 117 of the drain pan 100. That is, the raised surface 132 may extend substantially co-planar to a plane formed by the lateral axis 102 and the longitudinal axis 106. A lower end portion of the heat exchanger 30 may rest on the raised surface 132 in an installed configuration of the heat exchanger 30, such that the raised surface 132 may support a weight of the heat exchanger 30 and a weight of components that may be coupled to the heat exchanger 30. As such, the drain pan 100 may directly support the heat exchanger 30 without use of a dedicated support frame or other structure configured to suspend the heat exchanger 30 above the drain pan 100.

In some embodiments, the raised surface 132 includes a spine 140 that extends along a portion or substantially all of the length 112 of the drain pan 100. For example, the spine 140 may extend continuously along the fourth wall 126 and/or from the first wall 120 to the third wall 124. The raised surface 132 may include one or more protrusions 142 that extend from the spine 140 in a direction transverse to the length 112. For example, as discussed in detail below, the protrusions 142 may extend from the spine 140 generally along an angle of incline of the draining surface 130.

The draining surface 130 is configured to receive condensate that may be generated during operation of the heat exchanger 30 and to direct the generated condensate toward a drain port 148 of the drain pan 100. The drain port 148 may direct the condensate out of the drain pan 100. For example, the drain port 148 may be formed on the second wall 122 and/or disposed in the base 119, and the drain port 148 may be fluidly coupled to the drain spout 108, which may be configured to direct the condensate out of the HVAC unit 12. Additionally, the draining surface 130 may be sloped downwardly, with respect to gravity, toward the drain port 148, such that gravity may direct condensate accumulated on the draining surface 130 toward the drain port 148. In particular, the draining surface 130 may include a compound slope that extends downwardly, with respect to gravity, and along the length 112 of the drain pan 100 from the first end portion 114 to the second end portion 116 of the drain pan 100. The compound slope of the draining surface 130 may also extend downwardly, with respect to gravity, and along the width 117 of the drain pan 100 from the fourth wall 126 to the second wall 122 of the basin 118. Indeed, the compound slope may include a first slope that extends downwardly, with respect to gravity, and along the lateral axis 102 in a first direction 150, and the compound slope may include a second slope that extends downwardly, with respect to gravity, and along the longitudinal axis 106 in a second direction 152. Accordingly, the compound slope of the draining surface 130 may enable condensate dripping or collecting on the draining surface 130 to flow generally along a direction of decline 154 of the draining surface 130, which may correlate to a combined magnitude of the first slope and a magnitude of the second slope of the draining surface 130.

In some embodiments, gravity may direct condensate along the draining surface 130 in the direction of decline 154 until the condensate engages with the second wall 122 of the basin 118. Upon engaging with the second wall 122, the condensate may flow generally along the second wall 122 in the first direction 150 toward the drain port 148, which may be located proximate to a lower-most portion, with respect to gravity, of the draining surface 130. Indeed, in some embodiments, the draining surface 130 may terminate at the drain port 148. In certain embodiments, the draining surface 130 may be a substantially planar surface that is oriented to include the compound slope. In other embodiments, the draining surface 130 may include a curved surface or a contoured surface.

In certain embodiments, the body portion 110 includes one or more inclined flanges that are disposed about a portion of or substantially all of a perimeter of the basin 118. In the illustrated embodiment, the body portion 110 includes a first inclined flange 190 that extends from the first wall 120 of the basin 118 and a second inclined flange 192 that extends from the second wall 122 of the basin 118. The inclined flanges 190, 192 may facilitate direction of condensate into the basin 118, such as when the condensate does not drip directly into the basin 118 from the heat exchanger 30. In some embodiments, the first inclined flange 190 includes a unidirectional slope that extends downwardly, with respect to gravity, and along the length 112 of the drain pan 100 from a distal end 194 of the first inclined flange 190 to the first wall 120. The second inclined flange 192 may include a unidirectional slope that extends downwardly, with respect to gravity, and along the width 117 of the drain pan 100 from a distal end 196 of the second inclined flange 192 to the second wall 122. As noted above, the first and/or second inclined flanges 190, 192 may be configured to collect condensate that may not drip directly into the basin 118 during operation of the heat exchanger 30.

For example, when the heat exchanger 30 is in an installed configuration on the drain pan 100, a blower or other suitable fluid flow generating device may be configured to direct a flow of outdoor air or another air flow across the heat exchanger 30 in the second direction 152 to facilitate heat exchange between refrigerant circulating through the heat exchanger 30 and the air flow. In some embodiments, the air flow may flow across the heat exchanger 30 with sufficient force to dislodge a portion of condensate that may accumulate on an exterior surface of the heat exchanger 30 during operation of the heat exchanger 30. Accordingly, the air flow may cast this condensate from the heat exchanger 30 in the second direction 152 before the condensate drips from the heat exchanger 30, via gravity, into the basin 118. As such, this portion of condensate may be ejected from the heat exchanger 30 in a generally parabolic trajectory in the second direction 152, such that the ejected condensate may be blown downstream of the basin 118. Therefore, the drain pan 100 includes, for example, the second inclined flange 192, which may be disposed downstream of the basin 118, relative to a direction of air flow across the heat exchanger 30, and which is configured to catch condensate that is cast from the heat exchanger 30 via the air flow. Due to the aforementioned downward slope of the second inclined flange 192, the second inclined flange 192 may direct ejected condensate that drips onto the second inclined flange 192 along a fourth direction 199 into the basin 118. That is, the second inclined flange 192 may direct ejected condensate in an upstream direction, relative to a direction of air flow across the heat exchanger 30, and into the basin 118.

Figure 7:
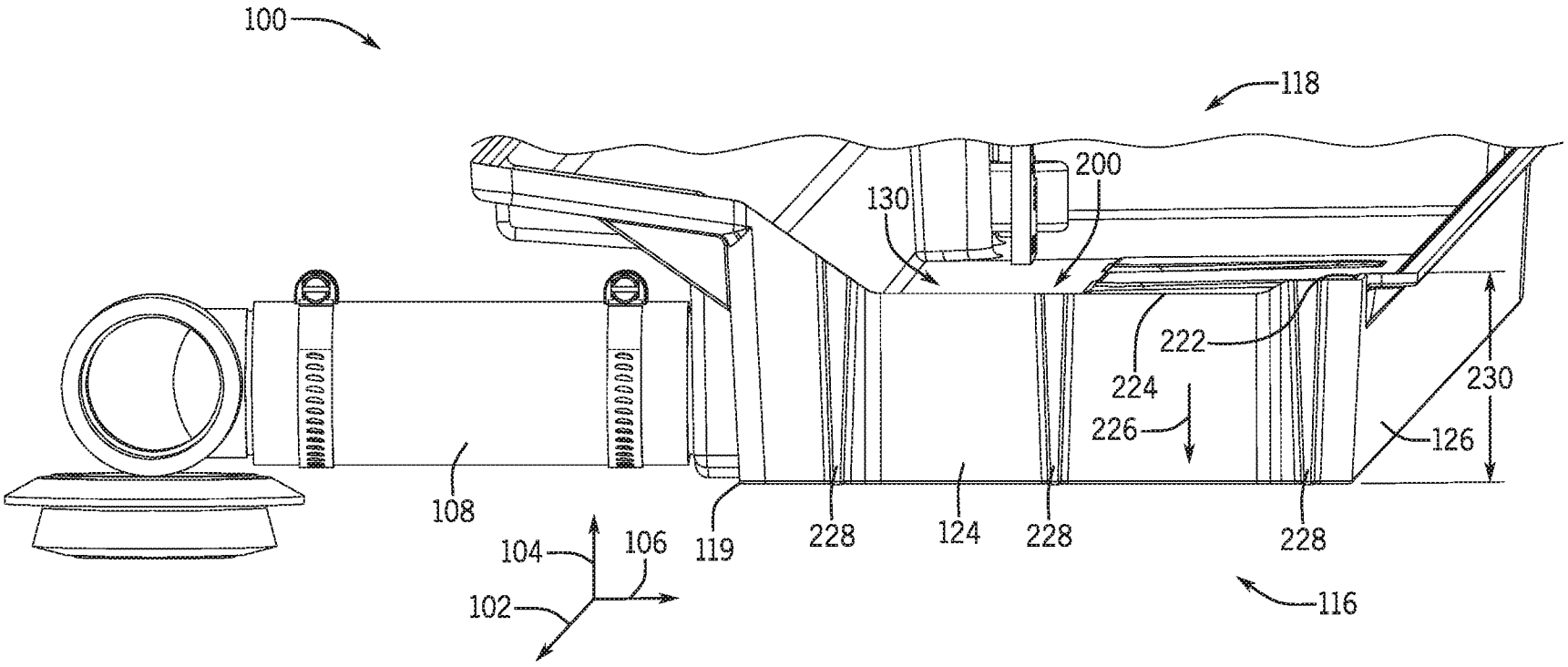
FIG. 7 is an expanded side perspective view of an embodiment of a drain pan, in accordance with an aspect of the present disclosure.

FIG. 7 is a front perspective view of an embodiment of the drain pan 100, illustrating the third side wall 124 in greater detail. The draining surface 130 of the basin 118 may be downwardly sloped to direct condensate toward the third side wall 124 so as to direct the condensate toward the drain spout 108. For this reason, some of the condensate may engage the third side wall 124 and accumulate proximate the second end portion 116. Additionally, the third side wall 124 may have a passage 220, such as an overflow passage, formed in the third side wall 124. The passage 220 may be formed in or proximate a first top edge 222 of the third side wall 124 and may have a geometry that enables the passage 220 to facilitate overflow of the condensate out of the basin 118. For example, the illustrated passage 220 is a notch formed downward along the vertical axis 104 into the first top edge 222. Thus, a second top edge 224 of the third side wall 124 formed by the passage 220 is lower than the first top edge 222 of the third side wall 124 and other top edges of the other side walls 120, 122, 126 relative to the vertical axis 104. As such, when a level of the condensate accumulated at the second end portion 116 of the basin 118 reaches or exceeds the second top edge 224, the condensate may begin to overflow out of the drain pan 100 over the second top edge 224 rather than over the first top edge 222 of the third side wall 124 or over another top edge of the drain pan 100. In this manner, the drain pan 100 generally directs the condensate to overflow out of the basin 118 via the passage 200, which may controllably remove condensate overflow from the drain pan 100.

For example, the condensate overflow may flow out of the basin 118 via the passage 200 and may flow along the third side wall 124 on an exterior side of the third side wall 124 opposite the basin 118, such as in a downward direction 226 along the vertical axis 104. The overflow condensate may then flow from the third side wall 124 to a targeted location, such as toward a drain of the HVAC unit 12. By directing the condensate overflow to flow over and from the third side wall 124, the drain pan 100 may block inadvertent flow of the condensate overflow within the HVAC unit 12. For instance, the drain pan 100 may direct the condensate overflow away from other components or features of the HVAC unit 12 positioned adjacent to the drain pan 100. Although the illustrated passage 200 is formed into the third side wall 124 to form a generally U-shape in the third side wall 124, the passage 200 may have any other suitable shape formed in the third side wall 124 to direct condensate overflow out of the drain pan 100. For instance, additional or alternative embodiments of the passage 200 may include an opening, such as a hole or a slit, formed beneath the first top edge 222 of the third side wall 124. Moreover, passages may be formed in any of the other side walls of the drain pan 100, such as the first side wall 120, the second side wall 122, and/or the fourth side wall 126 to enable targeted overflow of condensate in any suitable direction.

In some embodiments, the drain pan 100 may be positioned within the HVAC unit 12 such that another component is positioned proximate to the third side wall 124 or other side wall having the passage 200. For this reason, the third side wall 124 may include an offset portion configured to abut the component to block condensate overflow from flowing onto or against the component. The offset portion may include a protrusion, a recess, or other suitable geometry to guide condensate overflow out of the drain pan 100. As an example, the offset portion includes ribs 228 in the illustrated embodiment. The ribs 228 may each extend along a height 230 of the third side wall 124 and along the vertical axis 104 from the base 119 of the drain pan 100 to the second top edge 224 of the third side wall 124. As further described herein, in an installed configuration of the drain pan 100, the ribs 228 may abut the component to form a space between the third side wall 124 and the component, and condensate overflow may flow within the spaces or channels defined by the third side wall 124 and/or the ribs 228. In certain embodiments, the ribs 228 may be integrally formed with a remainder of the drain pan 100. That is, the drain pan 100 may be a single component having the ribs 228 directly formed on the third side wall 124. For example, the drain pan 100 illustrated in FIGS. 6 and 7 may be formed from a plastic that is injection molded in a process that forms the third side wall 124 having the ribs 228. Thu, the drain pan 100 may be formed from a single piece of material. In additional or alternative embodiments, the ribs 228 may be separately formed from the third side wall 124. In such embodiments, the ribs 228 may be coupled to the third side wall 124, such as via a weld, an adhesive, a fastener, another suitable feature, or any combination thereof.

Figure 8:
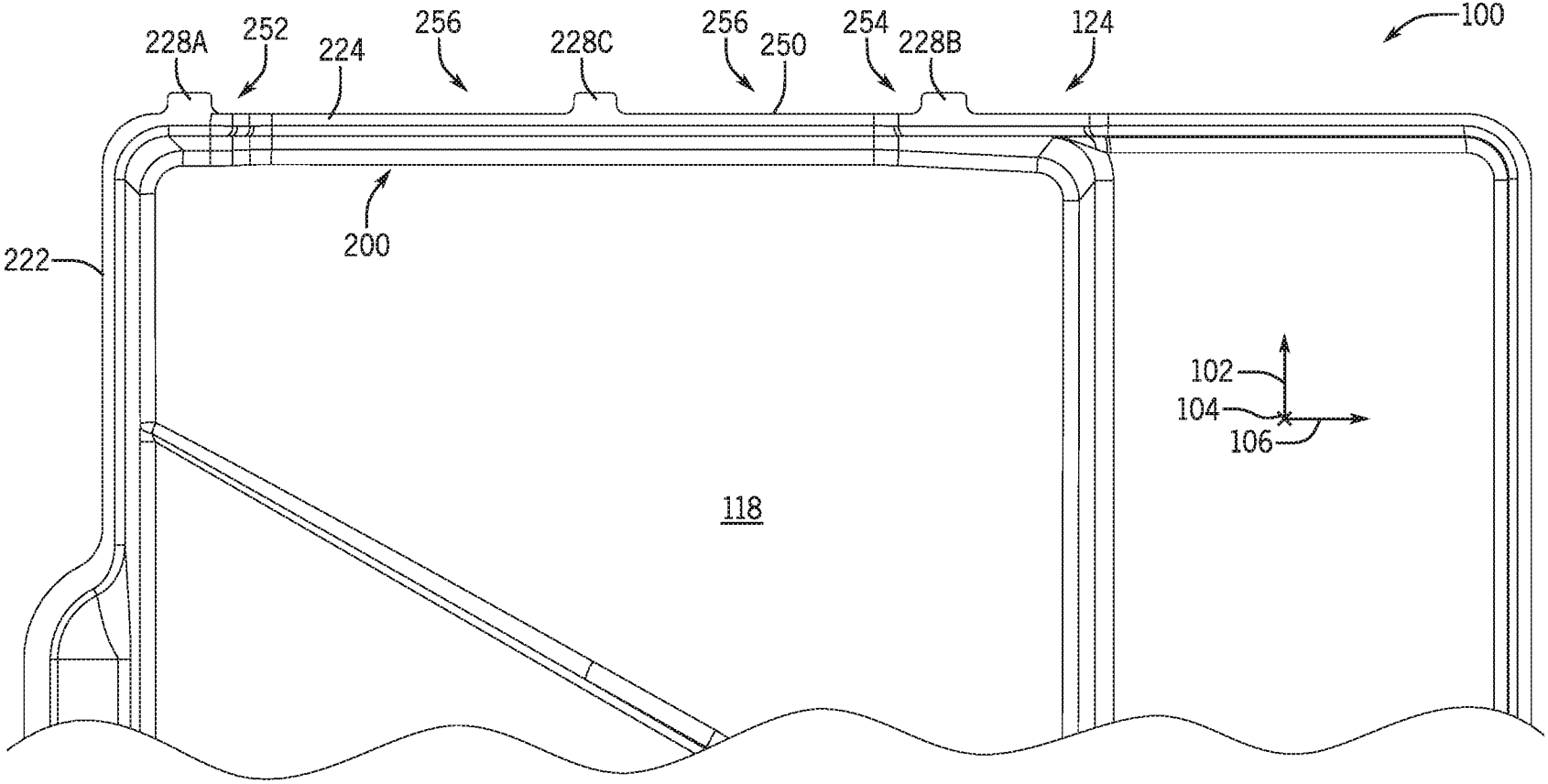
FIG. 8 is an expanded top view of the drain pan of FIG. 7, in accordance with an aspect of the present disclosure.

FIG. 8 is a top view of the drain pan 100 of FIG. 7. Each rib 228 of the third side wall 124 extends from an outer surface 250 of the third side wall 124 along the lateral axis 102. In the illustrated embodiment, the third side wall 124 includes a first rib 228A formed at a first side 252 of the passage 200, a second rib 228B formed at a second side 254 of the passage 200, and a third rib 228C formed between the first rib 228A and the second rib 228B. In alternative embodiments, the third side wall 124 may include any suitable number of ribs 228, such as a pair of ribs 228 formed at each side 252, 254 of the passage 200, a single rib 228, or greater than three ribs 228.

As shown in FIG. 8, each rib 228 may extend away from the outer surface 250 of the third side wall 124, and a respective channel 256 is formed between each pair of ribs 228 and in alignment with the passage 200 along the longitudinal axis 106. In this way, in the installed configuration of the drain pan 100, the ribs 228 may abut another component of the HVAC unit 12, and the abutment between the component and the ribs 228 may enclose each channel 256 to form a respective opening through which the condensate overflow may flow. Thus, each channel 256 may receive condensate overflow from the basin 118. That is, the condensate may flow over the second top edge 224 and along the outer surface 250 and/or along the ribs 228 to flow through the channel 256, rather than onto the component abutting the drain pan 100. Accordingly, the ribs 228 enable a reduction of condensate overflow onto or toward the component and/or other components of the HVAC unit 12.

Additionally or alternatively, the channel 256 may be created by forming a recess along the outer surface 250 of the third side wall 124. In other words, rather than extending the ribs 228 away from the outer surface 250, the offset portion may extend toward the basin 118, such as an inner portion of the basin 118. Thus, during manufacture of the drain pan 100, material may be removed from the third side wall 124 to form the ribs 228 and the channel 256 that is in alignment with the passage 200.

Figure 9:
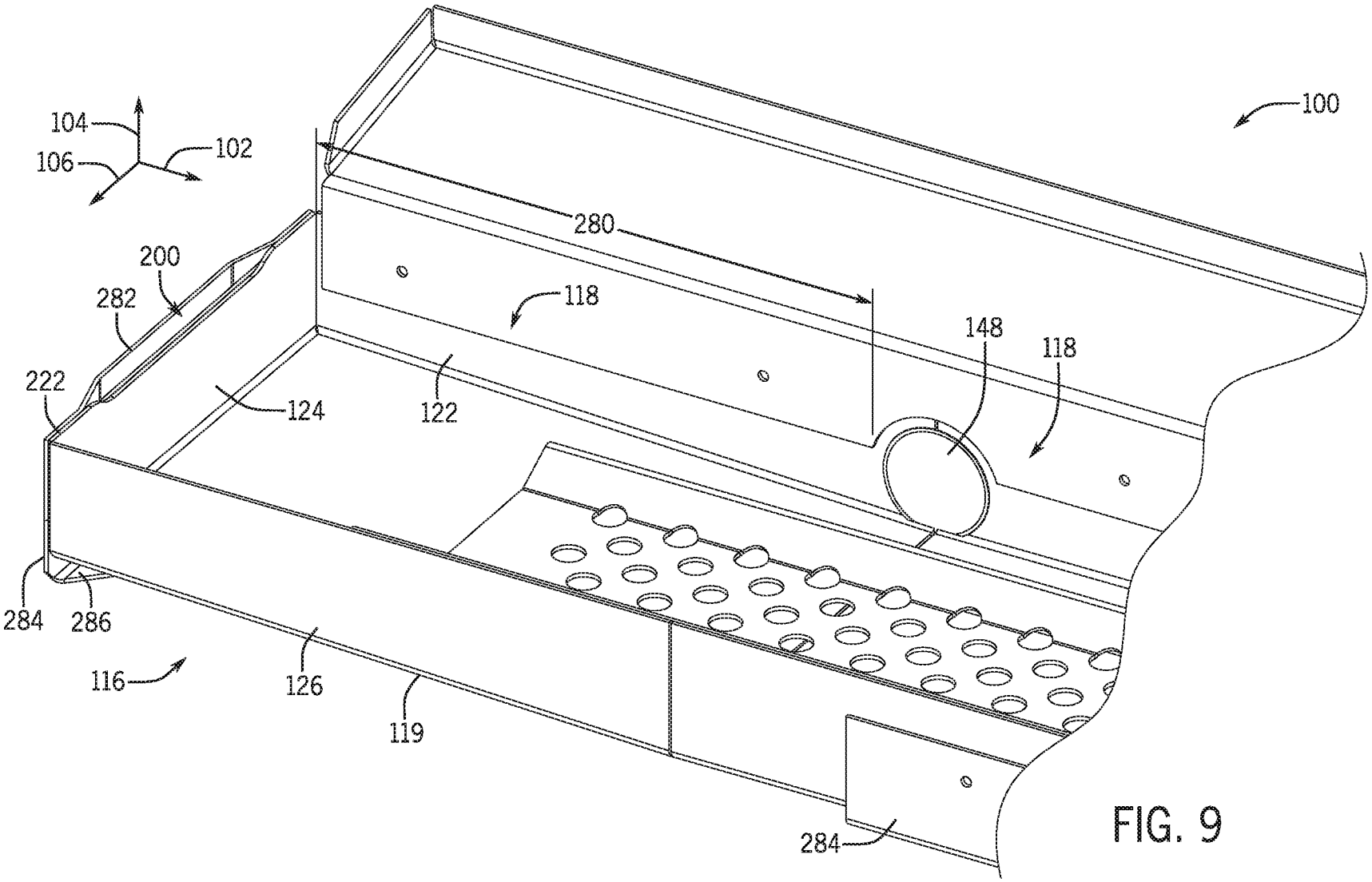
FIG. 9 is an expanded perspective view of an embodiment of a drain pan, in accordance with an aspect of the present disclosure.

FIG. 9 is a side perspective view of an embodiment of the drain pan 100. In the illustrated embodiment, the drain port 148 is formed in the second side wall 122 adjacent to the third side wall 124 at the second end portion 116 of the drain pan 100. For instance, the drain port 148 may be offset from the third side wall 124 by a distance 280. As a result, the condensate may accumulate at the second end portion 116 against the third side wall 124 when the condensate does not flow out of the basin 118 via the drain port 148 at a sufficient rate.

Moreover, the third side wall 124 of the illustrated drain pan 100 also includes the passage 200 formed in the first top edge 222 of the third side wall 124 to facilitate overflow of condensate from the basin 118 via the passage 200. The drain pan 100 also includes an outer plate 282 configured to couple to the third side wall 124. As described herein, the outer plate 282 may include another offset portion configured to abut a component of the HVAC system 12 in installed configuration of the drain pan 100. Thus, the outer plate 282 may block the condensate overflow from flowing toward or onto the component. Moreover, the drain pan 100 may include an inner plate 284 configured to couple to the third side wall 124. The inner plate 284 may have a foot 286 configured to support the base 119 in the installed configuration. By way of example, the drain pan 100 may be positioned onto a surface of the HVAC system 12, and the foot 286 may elevate the base 119 of the drain pan 100 from the surface along the vertical axis 104. The drain pan 100 may also include additional inner plates 284 coupled elsewhere to the drain pan 100, such as to first side wall 120, to the second side wall 122, to the fourth side wall 126, or any combination thereof. The additional inner plates 284 may each include a respective foot 286 to support the drain pan 100 in the installed configuration.

Figure 10:
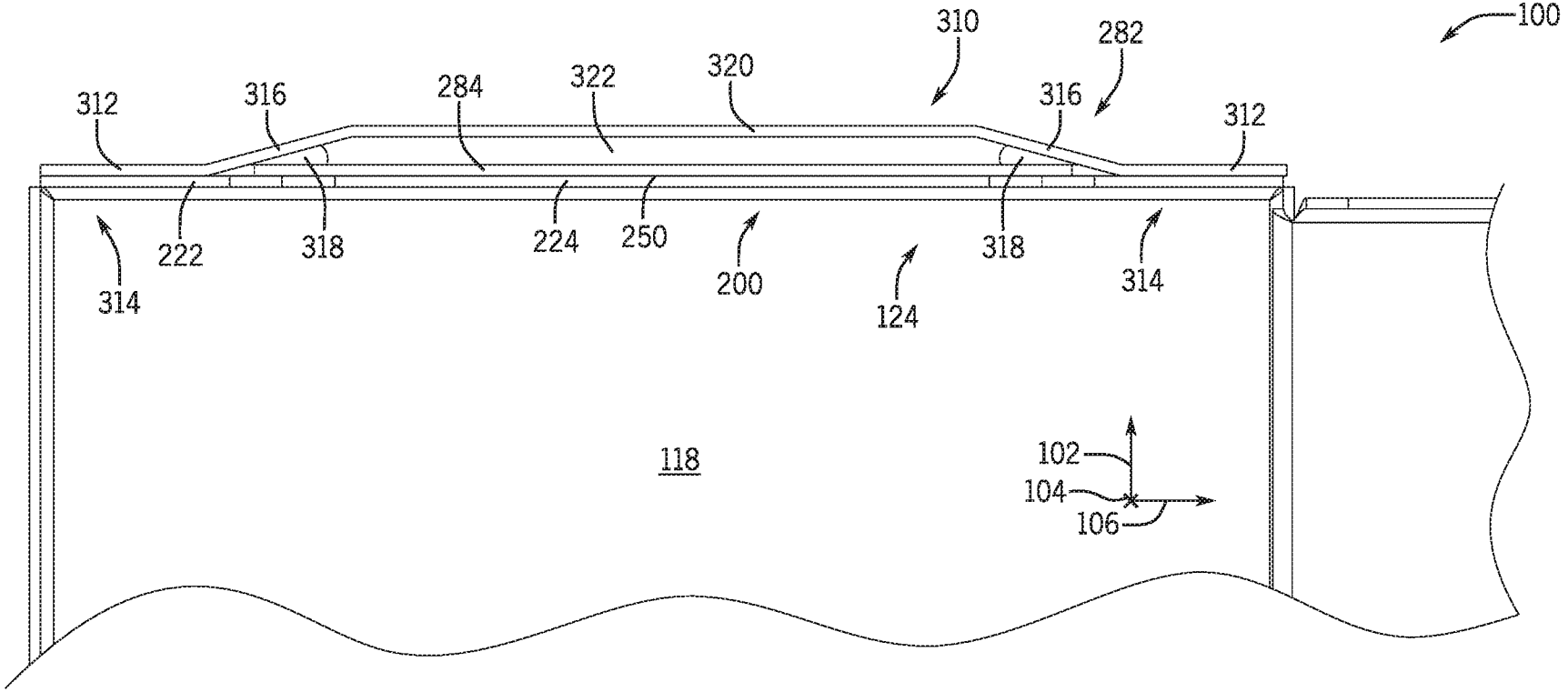
FIG. 10 is an expanded top view of the drain pan of FIG. 9, in accordance with an aspect of the present disclosure.

FIG. 10 is a top view of the drain pan 100 of FIG. 9 in which the outer plate 282 and the inner plate 284 are coupled to the third side wall 124. The outer plate 282 may include an offset portion 310 that extends away from the outer surface 250 of the third side wall 124 along the lateral axis 102. For example, the outer plate 282 may include lateral flanges 312 that are configured to couple to lateral sides 314 of the third side wall 124. The lateral sides 314 include portions of the third side wall 124 that do not define the passage 200. In other words, the passage 200 does not extend into the first top edge 222 at the lateral sides 314 of the third side wall 124. The outer plate 282 may also include support flanges 316 extending from the lateral flanges 312 away from the lateral flanges 312 at respective angles 318 to extend in a direction along the lateral axis 102 and the longitudinal axis 106. The outer plate 282 further includes an elevated surface or edge 320 relative to the lateral flanges 312 along the lateral axis 102 and connected to the support flanges 316. The elevated surface 320 generally extends along the longitudinal axis 106 and above the passage 200 relative to the lateral axis 102 in the installed configuration of the drain pan 100. Thus, the elevated surface 320 is offset from the outer surface 250 along the lateral axis 102, thereby forming a channel 322 between the outer surface 250 and the offset portion 310.

The offset portion 310 may generally extend along a height of the third side wall 124 relative to the vertical axis 104. In some embodiments, the offset portion 310 may abut against a component of the HVAC unit 12 in the installed configuration of the drain pan 100. Furthermore, the channel 322 formed by the offset portion 310 may receive the condensate overflowing out of the basin 118 via the passage 200. Thus, the offset portion 310 blocks the condensate overflow from contacting the component and, instead, may direct the condensate overflow in a desirable direction. In the illustrated embodiment, the inner plate 284 extends across the offset portion 310 along the longitudinal axis 106 such that the inner plate 284 generally extends between the elevated surface 320 of the outer plate 282 and the outer surface 250 of the third side wall 124. As a result, the condensate overflow may flow within the channel 322 between the inner plate 284 and the elevated surface 320 to flow desirably out of the drain pan 100. Although the present embodiment illustrates the channel 322 having a geometry configured to direct the condensate overflow generally along the vertical axis 104, in additional or alternative embodiments, the channel 322 may have a shape configured to direct the condensate overflow along the lateral axis 102 and/or the longitudinal axis 106 in addition to along the vertical axis 104, such as by having a curved geometry to redirect the condensate overflow along the inner plate 284.

Figure 11:
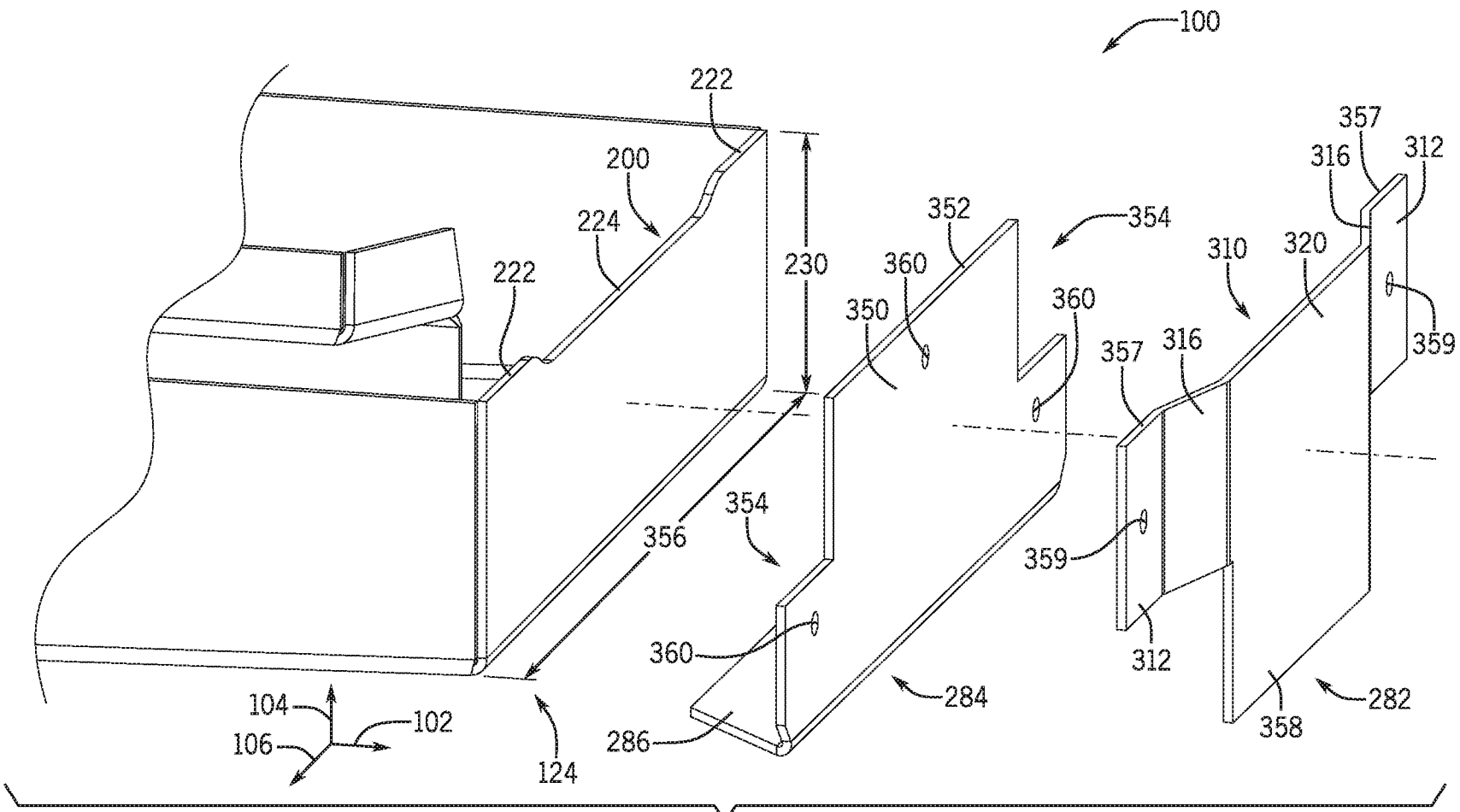
FIG. 11 is an exploded perspective view of the drain pan of FIGS. 9 and 10, in accordance with an aspect of the present disclosure.

FIG. 11 is an exploded perspective view of the drain pan 100 of FIGS. 9 and 10 having the outer plate 282 and the inner plate 284. The illustrated inner plate 284 includes a middle section 350 that may be positioned below the passage 200 of the third side wall 124 in the installed configuration of the drain pan 100. For example, a third top edge 352 of the middle section 350 may be substantially flush with the second top edge 224 of the third side wall 124 to avoid blocking the condensate overflow from flowing through the passage 200. Furthermore, the inner plate 284 may also include lateral cut-outs 354 that are formed in sides of the inner plate 284. The lateral cut-outs 354 may enable the outer plate 282 to couple to the third side wall 124 directly. For example, the lateral cut-outs 354 may be shaped so as to receive and accommodate a corresponding geometry of the lateral flanges 312 of the outer plate 282, thereby enabling the lateral flanges 312 to couple directly to the third side wall 124. In this manner, in the installed configuration, the offset portion 310 of the outer plate 282 may extend over the middle section 350 of the inner plate 284, and the condensate overflow may generally flow between the middle section 350 of the inner plate 284 and the offset portion 310 of the outer plate 282. Although the illustrated outer plate 282 includes two support flanges 316 and two lateral flanges 312, and the illustrated inner plate 284 includes two lateral cut-outs 354, additional or alternative embodiments of the outer plate 282 may include any suitable number of lateral flanges 312 and support flanges 316, and the inner plate 284 may include any corresponding number of lateral cut-outs 354 configured to receive the lateral flanges 312 to enable the outer plate 282 to couple directly to the third side wall 124.

Moreover, the foot 286 of the inner plate 284 may extend along a width 356 of the drain pan 100 in the installed configuration to support the drain pan 100. The foot 286 may also extend substantially linearly and transversely from the middle section 350. Thus, the inner plate 284 may have an L-shaped side profile. In additional or alternative embodiments, the foot 286 may have any other suitable shape, such as a curved shape, for supporting the drain pan 100.

The outer plate 282 may generally extend along the height 230 of the drain pan 100. For example, a fourth top edge 357 of the outer plate 282 may be substantially flush with the first top edge 222 of the third side wall 124, and/or a bottom edge 358 of the elevated surface 320 of the outer plate 282 may be substantially flush with the foot 286 of the inner plate 284 in the installed configuration. In additional or alternative embodiments, the outer plate 282, such as the elevated surface 320 of the outer plate 282, may extend along merely a portion of the height 230 of the drain pan 100, rather than along the entire height 230.

In the illustrated embodiment, the outer plate 282 has first holes 359 formed in the lateral flanges 312, and the inner plate 284 has second holes 360, which may be formed in the middle section 350. The first holes 359 and the second holes 360 may each align with respective holes formed in the third side wall 124, and a respective fastener may be inserted into each aligned hole to couple the outer plate 282 and/or the inner plate 284 to the third side wall 124. In additional or alternative embodiments, the outer plate 282 and the inner plate 284 may be configured to couple to the third side wall 124 by using another feature. For example, the drain pan 100, the outer plate 282, and/or the inner plate 284 may be formed from a metal material, such as stainless steel, and the drain pan 100, the outer plate 282, and/or the inner plate 284 may be coupled to one another via welding. In further embodiments, the drain pan 100, the outer plate 282, and/or the inner plate 284 may be coupled to one another via an adhesive, a tab, a punch, an interference fit, another feature, or any combination thereof. In any case, the outer plate 282 and the inner plate 284 of the drain pan 100 illustrated in FIGS. 9-11 may be separate components configured to couple to one another. Moreover, the drain pan 100, the outer plate 282, and/or the inner plate 284 may be formed from any suitable material, such as a polymeric and/or a composite material, to direct the condensate overflow through the offset portion 310 and to support the drain pan 100.

Moreover, in additional or alternative embodiments, the outer plate 282 and the inner plate 284 may be integrally formed as a single component. Thus, the single component may have features of both the outer plate 282 and the inner plate 284, and the single component may be coupled to the third side wall 124 such that separate plates are not manufactured and coupled to the third side wall 124. Further still, features of the outer plate 282 and/or of the inner plate 284 may be integrally formed with a remainder of the drain pan 100. For example, the offset portion 310 and/or the foot 286 may be formed into the third side wall 124. As such, the drain pan 100 may not include separate plates or components that are coupled to the drain pan 100.

The present disclosure may provide one or more technical effects useful in the operation of an HVAC system. For example, a drain pan may be configured to collect condensate generated by the HVAC system. The drain pan may include a drain port configured to direct the collected condensate out of the drain pan to be removed from the HVAC system. The drain pan may also have a passage configured to facilitate overflow of the condensate out of the drain pan in a desirable manner through the HVAC system. As an example, the passage may be formed into one of the side walls of the drain pan, such as in one a top edge of the side wall, to enable the overflow of the condensate to flow out of the drain pan via the passage rather than another section of the drain pan. Additionally, the drain pan may include an offset portion that is adjacent to the passage. The offset portion may abut other equipment of the HVAC system in an installed configuration of the drain pan to block the overflow of the condensate from flowing to the other equipment. In some embodiments, the offset portion may be integrally formed with the drain pan, but the offset portion may additionally or alternatively be a part of a separate component, such as a plate, configured to couple to the drain pan. In any case, the offset portion may form a space between the drain pan and the other equipment such that the overflow of condensate is directed through the space and does not contact the other equipment. As such, the drain pan may block the overflow of the condensate from affecting a performance of the HVAC system, thereby improving an operation of the HVAC system. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims.

The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) unit, comprising:

a drain pan including a basin defined by a base and a plurality of side walls configured to collect condensate from an evaporator of the HVAC unit;

a drain port disposed in the base of the basin and arranged such that the drain pan is configured to direct the condensate toward the drain port and out of the basin;

an offset portion extending from an outer surface of a side wall of the plurality of side walls; and a passage proximate to a top edge of the side wall of the plurality of side walls and configured to facilitate overflow of the condensate out of the basin and along the offset portion.

2. The HVAC unit of claim 1, wherein the passage is a notch formed in the top edge.

3. The HVAC unit of claim 1, wherein the offset portion is a single protrusion extending outwardly from the outer surface and along a height of the side wall of the plurality of side walls.

4. The HVAC unit of claim 3, wherein the height extends from the base to the top edge of the side wall of the plurality of side walls.

5. The HVAC unit of claim 1, wherein the offset portion includes a pair of protrusions disposed on either side of the passage and forming a channel configured to receive the condensate from the passage.

6. The HVAC unit of claim 1, wherein the offset portion includes a plurality of ribs integrally formed with the side wall of the plurality of side walls.

7. The HVAC unit of claim 1, comprising an outer plate having the offset portion and coupled to the side wall of the plurality of side walls.

8. The HVAC unit of claim 7, wherein the drain pan is a metal drain pan and the outer plate includes a metal outer plate that is coupled to the drain pan.

9. The HVAC unit of claim 1, wherein the offset portion includes a recess extending toward an inner portion of the basin and forming a channel in alignment with the passage.

10. A drain pan for a heating, ventilation, and/or air conditioning (HVAC) unit, comprising:

a base;

a plurality of side walls integrally formed with the base to define a basin configured to collect condensate generated by the HVAC unit;

a drain port extending through the base or a first side wall of the plurality of side walls and configured to direct the condensate out of the basin;

an offset portion extending from an outer surface of a second side wall of the plurality of side walls; and a passage proximate to a top edge of the second side wall of the plurality of side walls and configured to facilitate overflow of the condensate out of the basin and along the offset portion.

11. The drain pan of claim 10, wherein the basin includes a draining surface that is sloped downwardly toward the drain port such that the basin is configured to direct the condensate toward the drain port and the passage.

12. The drain pan of claim 10, wherein the passage is formed into the top edge of the second side wall of the plurality of side walls, and the passage includes a U-shape.

13. The drain pan of claim 10, wherein the offset portion is integrally formed with the second side wall of the plurality of side walls.

14. The drain pan of claim 10, wherein the offset portion is a protrusion extending outwardly from the outer surface and wherein the drain pan comprises an outer plate having the offset portion and coupled to the second side wall of the plurality of side walls.

15. The drain pan of claim 14, comprising an inner plate coupled to the second side wall of the plurality of side walls, wherein the inner plate includes a foot configured to support the base, and the offset portion is offset from a middle section of the inner plate to define a channel configured to direct condensate received via the passage to flow between the middle section of the inner plate and the protrusion of the outer plate.

16. The drain pan of claim 15, wherein the foot of the inner plate extends transversely with respect to the middle section, and the foot extends along a width of the drain pan.

17. The drain pan of claim 15, wherein the inner plate and the outer plate are each coupled to the second side wall via a fastener, a weld, an adhesive, a tab, a punch, an interference fit, or any combination thereof.

18. The drain pan of claim 15, wherein the outer plate has a lateral flange extending from the protrusion, and the lateral flange is coupled to the second side wall of the plurality of side walls to couple the outer plate to the drain pan.

19. The drain pan of claim 18, wherein the inner plate has a lateral cut-out configured to receive the lateral flange such that the lateral flange is directly coupled to the second side wall of the plurality of side walls.

20. A heating, ventilation, and/or air conditioning (HVAC) unit, comprising:

a drain pan including a base, a plurality of side walls integrally formed with the base, a basin defined by the base and the plurality of side walls, and a passage formed in a side wall of the plurality of side walls, wherein the basin is configured to collect condensate from an evaporator of the HVAC unit, and the passage is configured to direct condensate overflow out of the basin;

a drain port disposed in the base or one of the plurality of side walls and configured to direct the condensate out of the basin; and an offset portion extending from an outer surface of the side wall of the plurality of side walls proximate the passage, such that the condensate overflow is directed through the passage and along the offset portion.

21. The HVAC unit of claim 20, wherein the passage is formed into the side wall of the plurality of side walls such that a first top edge of the side wall is above a second top edge of the side wall along a vertical axis, and the passage is configured to direct the condensate overflow out of the basin over the second top edge.

22. The HVAC unit of claim 21, comprising a plate having the offset portion, wherein the plate is coupled to the side wall of the plurality of side walls, the offset portion is offset from and extends across the side wall to form a channel extending along a height of the side wall, and the channel is configured to receive the condensate overflow directed by the passage over the second top edge.

23. The HVAC unit of claim 22, wherein the plate is a first plate, the HVAC unit includes a second plate coupled to the side wall of the plurality of side walls, the second plate includes a foot configured to support the drain pan, and the second plate includes a third top edge that is substantially flush with the second top edge.

24. The HVAC unit of claim 20, wherein the offset portion includes a rib integrally formed with the side wall of the plurality of side walls.

25. The HVAC unit of claim 20, wherein the side wall is positioned at an end of the drain pan, the drain port is positioned proximate the end, and the basin includes a draining surface downwardly sloped toward the end and configured to direct the condensate toward the drain port and the side wall.

* * * * *